US006264358B1

(12) United States Patent
Eisaman et al.

(10) Patent No.: US 6,264,358 B1
(45) Date of Patent: Jul. 24, 2001

(54) STAND-ALONE, PORTABLE, STOVE TOP, CONSTANT SPOON STIRRING APPARATUS

(76) Inventors: Lanna Eisaman; Jennifer Bradford, both of 1322 Oak Ct., Harlingen, TX (US) 78550

( * ) Notice: Subject to any disclaimer, the term of this patent is extended or adjusted under 35 U.S.C. 154(b) by 0 days.

(21) Appl. No.: 09/294,122

(22) Filed: Apr. 19, 1999

(51) Int. Cl.[7] ..... B01F 11/04
(52) U.S. Cl. ..... 366/203; 366/278; 366/197
(58) Field of Search ..... 366/285, 286, 366/241, 243, 197, 332, 331, 276, 278, 199, 200, 201, 202, 203, 277; 99/348

(56) References Cited

U.S. PATENT DOCUMENTS

| | | | | |
|---|---|---|---|---|
| 945,522 | * | 1/1910 | Hall | 366/278 |
| 1,082,100 | * | 12/1913 | Schultz | 366/278 |
| 1,823,637 | * | 9/1931 | Wright | 366/278 |
| 1,914,807 | * | 6/1933 | Jackman | 366/197 |
| 2,584,202 | * | 2/1952 | Harp, Sr. | 366/197 |
| 3,856,273 | * | 12/1974 | Born | 366/276 |
| 4,023,780 | * | 5/1977 | Egid | 366/277 |
| 5,476,321 | * | 12/1995 | McNaughton | 366/241 |
| 5,533,805 | * | 7/1996 | Mandel | 366/285 |

FOREIGN PATENT DOCUMENTS

| | | | | |
|---|---|---|---|---|
| 723 046 | * | 4/1932 | (FR) | 366/276 |
| 1017712 | * | 5/1983 | (SU) | 366/241 |

* cited by examiner

*Primary Examiner*—Tony G. Soohoo
(74) *Attorney, Agent, or Firm*—John D. Gugliotta

(57) ABSTRACT

The invention is a motorized constant stirring spoon for pots and pans that constantly stirs or mixes foods that are being heated on top of a stove or range. The device can combine other attachments, such as a slotted spoon or whisk, and is powered by either an attached electrical cord that can be plugged into a conventional wall socket or run off batteries. The device's additional features may include a liquid level sensor to detect when the liquid is boiling over the pot; a built in thermometer; and an adjustment dial to adjust the stirring implement to the proper height.

3 Claims, 4 Drawing Sheets

STAND-ALONE, PORTABLE, STOVE TOP, CONSTANT SPOON STIRRING APPARATUS

RELATED APPLICATIONS

There are no previously filed, nor currently any co-pending applications, anywhere in the world.

BACKGROUND OF THE INVENTION

1. Field of the Invention

The present invention relates generally to an electric kitchen appliance used in food preparation and, more particularly, to a mixing or stirring appliance which can constantly stir the contents of a pot, pan or other conventional stove top cooking container.

2. Description of the Related Art

In the related art, electrical kitchen appliances used in food preparation, in particular those used for mixing and stirring, are well known.

These appliances can be divided into two groups. The appliances in the first group are of the type that simultaneously stir and mix the food ingredients in the same pot or vessel being used to heat or cool them. The second group are simply mixers with agitator shafts extending downwardly to mix the food ingredients. These types of devices are commonly associated with mixing and stirring ice cream products such as malts and milkshakes.

The problem with the appliances in the first group is that the food preparation container is an integrated part of the device. Typically, a shaft protrudes through an opening in the center of the container to drive an agitator which stirs the ingredients. Consequently, one cannot use the pot or pan of choice severely limiting the use of the device. The heating and cooling means are also integrated into the device adding to it's size and limiting it's portability. None of these devices can be used on a conventional stove top. The problem with the devices in the second group is that they were not designed for stirring ingredients cooking on a stove top. Again here one cannot use a selected pot or pan to be stirred because these units were designed for stirring a smaller container such as a cup. A pot or pan simply would not fit underneath the device. These devices are commonly associated with mixing and stirring ingredients used for making ice cream products.

A search of the prior art did not disclose any patents that read directly on the claims of the instant invention; however, the following references were considered related:

| U.S. Pat. No. | Inventor | Issue Date |
|---|---|---|
| 5,228,381 | Virgilio, et al. | Jul. 20, 1993 |
| 5,031,518 | Bordes | July 16, 1991 |
| 5,022,315 | Bertram, et al. | June 11, 1991 |
| 5,112,135 | Rupp | May 12, 1992 |
| 4,946,287 | Barnard, et al. | Aug. 7, 1990 |
| D 319,754 | Maass | Sep. 10, 1991 |
| D 319,946 | Barrault | Sep. 17, 1991 |

Of considerable relevance is U.S. Pat. No. 5,228,381, issued in the name of Virgilio, et al., U.S. Pat. No. 5,031,518, issued in the name of Bordis, U.S. Pat. No. 5,022,315, issued in the name of Bertram, et al., and U.S. Pat. No. D 319,754, issued in the name of Maass. While mixing features are incorporated into these inventions, the design of the present invention as a stand alone, portable, stove top, constant spoon stirring apparatus is different enough as to make the device distinguished over these and other references. U.S. Pat. No. 5,112,135, issued in the name of Rupp and U.S. Pat. No. 4,946,287, issued in the name of Barnard, et al. both are stand alone mixing devices with downwardly extending agitators similar to the present invention; however, there is no suggestion that either device be used to stir ingredients in a pot or pan while being heated on a stove top. Finally, U.S. Pat. No. D 319,946, issued in the name of Barrault is a design patent issued for an attachment for a food mixer of the type of devices with downwardly extending agitators described above but the design of the attachment bears no similarity to any of the agitators being contemplated for this invention.

Consequently, a need has been felt for providing a stove top appliance which is portable, stand alone, and can be used to constantly stir or mix food ingredients in any pot, pan, or conventional stove top container while heating allowing one to attend to other tasks.

SUMMARY OF THE INVENTION

It is therefore an object of the present invention to provide a portable, stove or counter top device that is used to provide a constant stirring motion in a pot, pan, or other conventional stove top container.

It is a feature of the present invention to provide a constant stirring device which can stir food ingredients in a pot, pan, or other conventional cooking container freeing the food preparer to attend to other tasks.

It is another feature of the present invention to provide an adjustable arm that allows the stirring spoon to be positioned at variable positions with respect to the base, allowing it to be placed inside pots and pans of varying depths.

It is another feature of the present invention to perform a sweeping motion of the spoon across the pot so as to provide a stirring motion.

It is another feature of the present invention to provide variable speed settings of the stirring action.

Briefly described according to the preferred embodiment of the present invention, a portable, stand-alone, stove top, constant spoon stirring apparatus is provided having a swing arm comprised of adjustment mechanisms allowing variable positions of the arm with respect to the base allowing it to be placed inside pots and pans of varying depths. The swing arm would be further comprised of adjustment mechanisms allowing variable positions of the arm with respect to the head allowing pots of varying size to be utilized.

The stirring action would consist of a pendulum type motion of the stirring utensil across the pot or pan being stirred.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

LIST OF REFERENCE NUMBERS

| | | | |
|---|---|---|---|
| 10 | stand-alone, portable, stove top, constant spoon stirring apparatus | 16 | electric motor |
| 11 | base | 17 | hub |
| 12 | adjustable arm | 18 | linkage |
| 13 | head | 19 | electric motor pedestal |
| 14 | stirring spoon | 20 | spoon pedestal and pivot |
| 15 | drive shaft | 21 | head lower plate |

DESCRIPTION OF THE PREFERRED EMBODIMENTS

The best mode for carrying out the invention is presented in terms of its preferred embodiment, herein depicted within the FIGS. 1–5.

1. Detailed Description of the Figures

Figure 1:
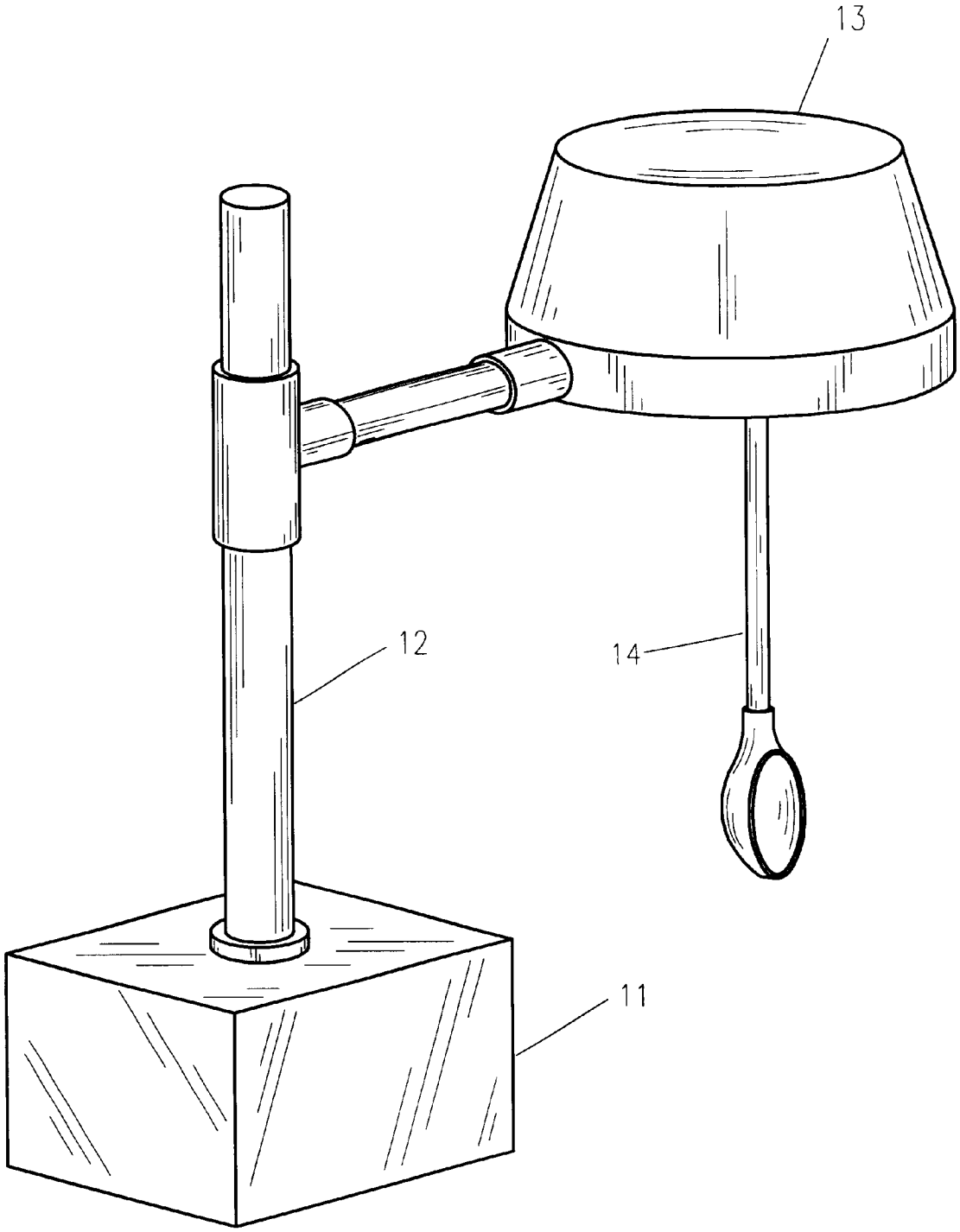
FIG. 1 is a perspective view of the constant stirring device.
Figure 2:
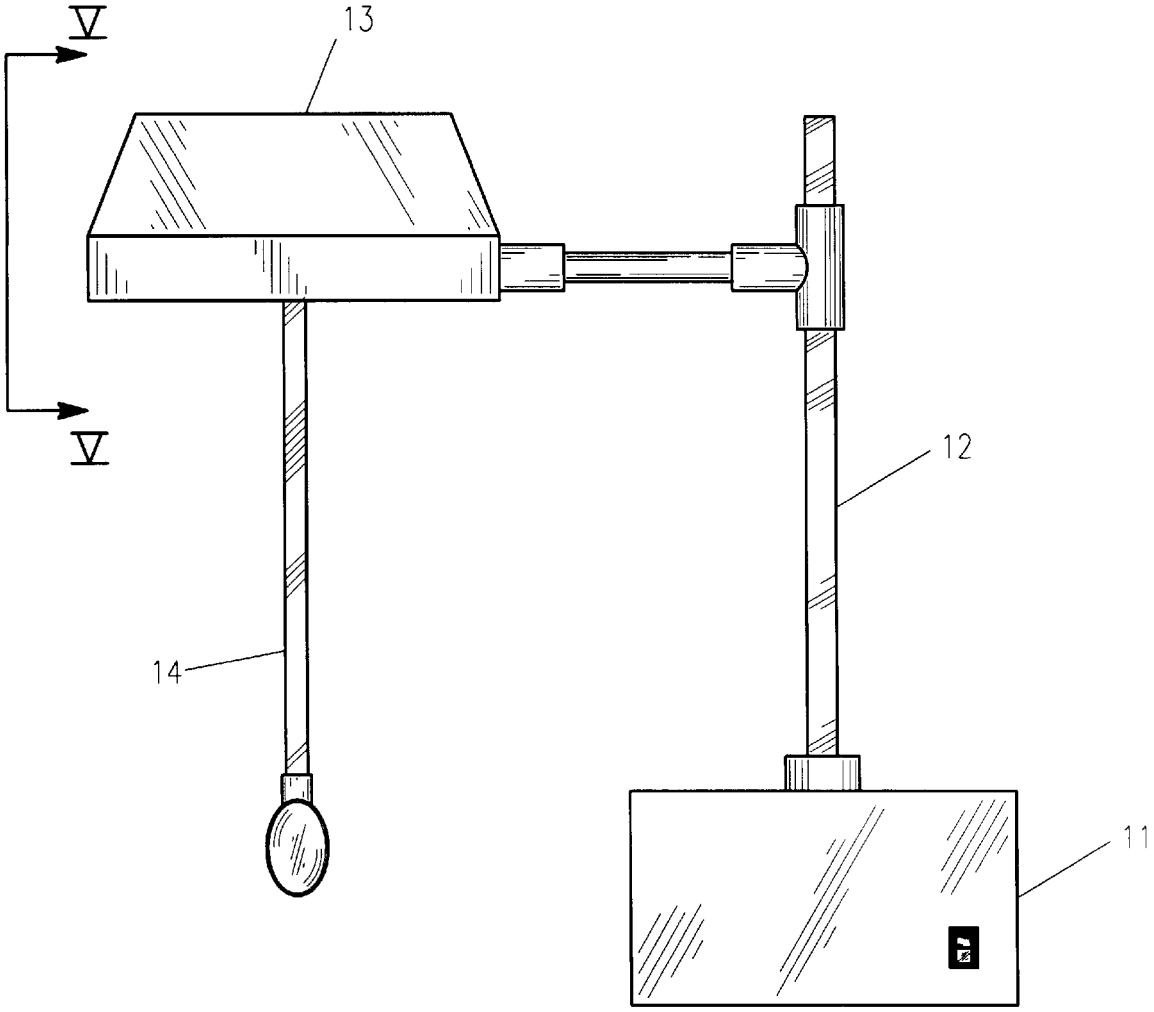
FIG. 2 is a side view of the device.

Referring now to FIG. 1, a perspective view of a constant stirring device 10 is shown. As shown in conjunction with FIG. 2, in its preferred embodiment the device 10 is comprised of a base 11 supporting a head 13 via an interconnected arm 12. The base I1 is envisioned forming a wide lower support surface and having sufficient ballast to be capable of supporting the head 13 in an offset or cantilevered manner via the adjustable arm 12. In this fashion the device 10 is capable of resting firmly, in a stand-alone fashion atop a stove, counter top, or other generally horizontal surface.

Figure 3:
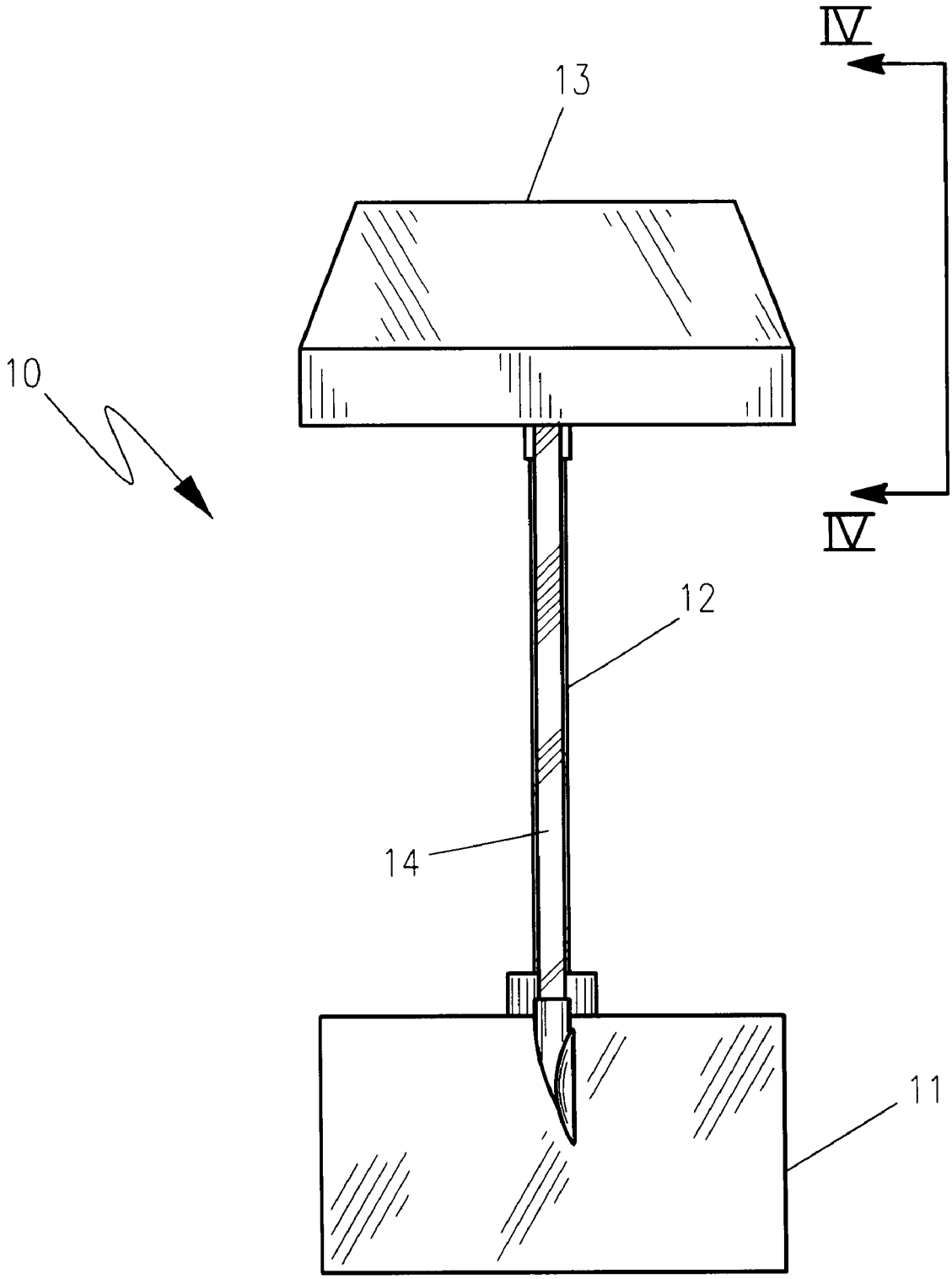
FIG. 3 is a front view of the device.

In conjunction with FIG. 3, which shows a side view of the constant stirring device of FIG. 1, the adjustable arm 12 is connected to the base 11 and head 13 in a manner as to allow the head 13 sufficient, unimpeded access to a pot, pan, or other conventional cooking container. FIG. 3 also shows a stirring spoon 14 pivotally connected to a spoon pedestal and pivot 20 which is housed inside the head 13 and resting on head lower plate 21, thereby allowing the head 13 further unimpeded access to a pot, pan, or other conventional cooking container.

Figure 4:
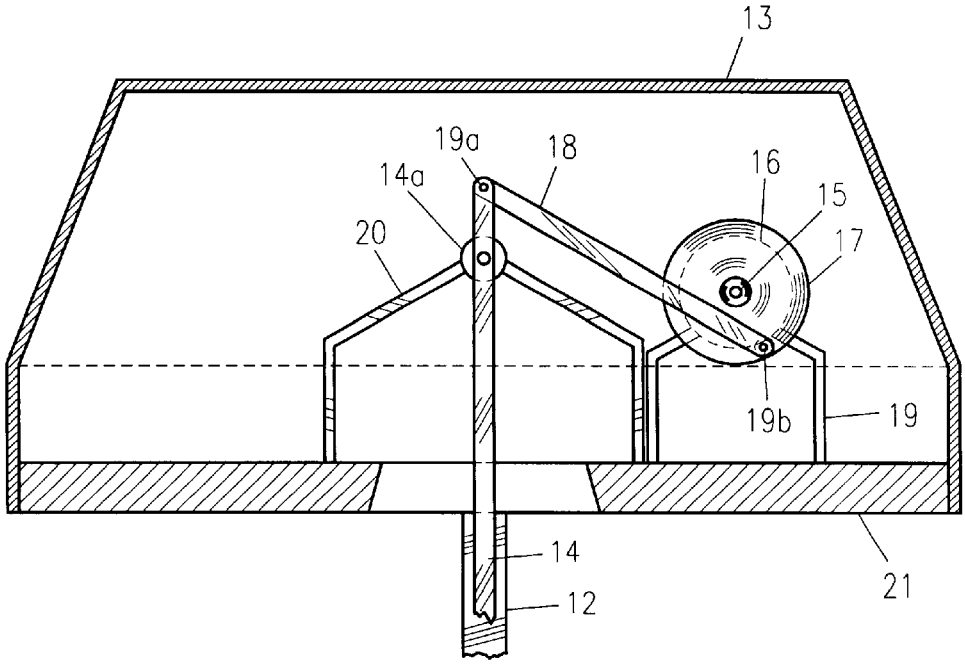
FIG. 4 is a front cross-sectional view of the head taken along line IV-IV of FIG. 3 of the device showing the means for creating the stirring action.

FIG. 4 shows a front longitudinal cross sectional view of the head 13 of the device 10. Although other methods for providing a drive mechanism are envisioned, for purposes of disclosure, FIG. 4 shows the best mode in which a driving means 25 comprises a hub 17 connected to a rotating drive shaft 15 of electric motor 16 for purposes of driving linkage 18 which is pivotally connected at an end 18a thereof to an upper end of stirring spoon 14 which in turn causes stirring spoon 14 to swing in a pendulum fashion about spoon pedestal pivot 20.

As seen in FIG. 4, the stirring spoon 14 is pivotally connected to the spoon pedestal pivot 20 at a fixed pivot 1 4a located just below the first pivot end 18a of the driving linkage 18. Driving linkage 18 is further connected at the second pivot end 18b to a rotating hub 17. Actuation of the electric motor 16 causes hub 17 to rotate which drives linkage 18 to actuate the stirring spoon 14 to swing about a fixed pivot 14a, formed by the pivotal connection of the stirring spoon 14 to the pedestal pivot 20, in a pendulum fashion back and forth a vertical plane. FIG. 4 also shows electric motor 16 supported and positioned by electric motor pedestal 19 resting on head lower plate 21 adjacent to the spoon pedestal and pivot 20.

Figure 5:
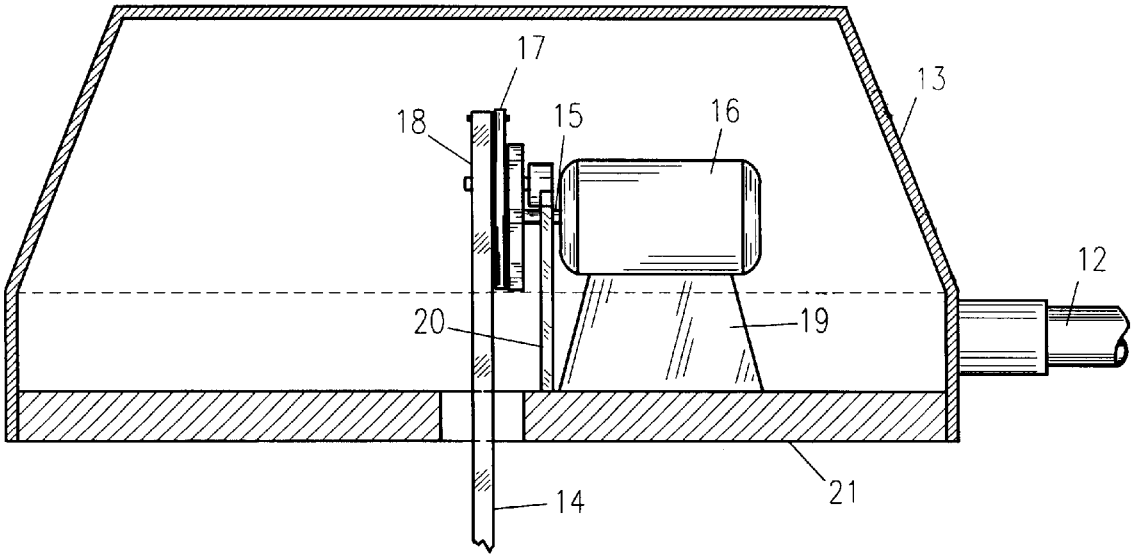
FIG. 5 is a side cross-sectional view of the head of FIG. 4 taken along the line of V—V of FIG. 2.

FIG. 5. is a side longitudinal cross sectional view of the head 13. As is further shown, the electric motor 16 is positioned relative to hub 17 and spoon pedestal and pivot 20.

2. Operation of the Preferred Embodiment

In operation, the present device 10 would be placed on either a stove or counter top. The stirring spoon 14 would be placed into a pot, pan, or other conventional cooking container containing the food ingredients to be stirred. The food preparer would adjust the height of the stirring spoon 14 for varying heights of pots or pans through the operation of an adjustment mechanism on arm 12. To begin stirring, one would merely turn power on to electric motor 16. Electric motor 16 would in turn rotate hub 17 driving linkage 18 to cause the stirring action of stirring spoon 14. The resultant stirring action would allow the food preparer to prepare recipes requiring constant stirring while heating to avoid burning and free the preparer to attend to other tasks. The constant stirring device may also be used to stir other recipes not requiring heating again freeing the preparer to attend to other tasks.

The foregoing description is included to illustrate the operation of the preferred embodiment and is not meant to limit the scope of the invention. The scope of the invention is to be limited only by the following claims.

What is claimed is:

1. A constant stirring device comprising:

a base;

a head connected to said base by an interconnected arm in a manner as to allow the head sufficient unimpeded access to a pot, pan, or other conventional cooking container; and a stirring spoon pivotally connected with a fixed pivot upon a spoon pedestal pivot;

a driving linkage having a first pivot connection at one end to said stirring spoon, and further having a second pivot connection to a drive means at the other end of said linkage, said drive means including a rotating hub whereby said drive means translates the rotation of the hub to produce a swinging of the stirring spoon in pendulum fashion about the fixed pivot of the spoon pedestal pivot along a vertical plane.

2. The constant stirring device of claim 1, wherein said base further comprises a wide lower support surface and having sufficient ballast to be capable of supporting said head in an offset or cantilevered manner relative to said base via the adjustable arm such that said device is capable of resting firmly, in a stand-alone fashion atop a stove, counter top, or other generally horizontal surface without tilting over thus alleviating any need by a user to support the constant stirring device with hands during operation.

3. The constant stirring device of claim 1, wherein the drive means comprises an electric motor and rotating shaft for rotating said hub.

* * * * *